US010047447B2

(12) United States Patent
Bustos Robledo et al.

(10) Patent No.: US 10,047,447 B2
(45) Date of Patent: Aug. 14, 2018

(54) METHOD OF SUPERIMPOSING ALTERNATING CURRENT ON DIRECT CURRENT IN ELECTROLYTIC METHODS

(71) Applicant: HECKER ELECTRONICA POTENCIA Y PROCESOS S.A., Santiago (CL)

(72) Inventors: Juan Pablo Bustos Robledo, Santiago (CL); Cristian Alejandro Villavicencio Araya, Santiago (CL)

(73) Assignee: HECKER ELECTRONICA POTENCIA Y PROCESOS S.A., Santiago (CL)

( * ) Notice: Subject to any disclaimer, the term of this patent is extended or adjusted under 35 U.S.C. 154(b) by 0 days.

(21) Appl. No.: 15/034,091

(22) PCT Filed: Nov. 18, 2014

(86) PCT No.: PCT/IB2014/066136
§ 371 (c)(1),
(2) Date: May 3, 2016

(87) PCT Pub. No.: WO2015/075634
PCT Pub. Date: May 28, 2015

(65) Prior Publication Data

US 2016/0355938 A1 Dec. 8, 2016

(30) Foreign Application Priority Data

Nov. 19, 2013 (CL) ..... 3315-2013

(51) Int. Cl.

| | |
|---|---|
| ***C25C 7/06*** | (2006.01) |
| ***C25C 1/12*** | (2006.01) |
| ***C25C 7/00*** | (2006.01) |

(52) U.S. Cl.
CPC ..... *C25C 7/06* (2013.01); *C25C 1/12* (2013.01); *C25C 7/00* (2013.01)

(58) Field of Classification Search
CPC ..... C25C 1/12; C25C 7/00; C25C 7/06
See application file for complete search history.

(56) References Cited

U.S. PATENT DOCUMENTS 2,026,466 A 12/1935 Grolee
4,170,739 A 10/1979 Frusztajer et al.
(Continued)

FOREIGN PATENT DOCUMENTS

FR 1178179 A 5/1959

OTHER PUBLICATIONS

International Search Report dated May 6, 2015 for PCT/IB2014/066136 and English translation.

*Primary Examiner* — Ciel P Thomas
(74) *Attorney, Agent, or Firm* — Lucas & Mercanti, LLP

(57) ABSTRACT

A process for superimposing AC over DC, which feeds a group of electrolytic cells for electrowinning or electrorefining copper and other products, characterized by (a) incorporating an inductor which is connected between the terminals of two consecutive middle cells of the group of electrolytic cells, wherein the inductor functions are to act as a filter for the AC and as conducting means for the DC; (b) incorporating a capacitor connected in parallel to the original DC source, wherein the capacitor functions are to act as conducting means for the AC and as a filter for the DC; and (c) incorporating an AC source connected to the terminals of an inductor installed in the middle point of the group of electrolytic cells.

4 Claims, 5 Drawing Sheets

(56) References Cited

U.S. PATENT DOCUMENTS

| | | | | |
|---|---|---|---|---|
| 6,179,984 | B1 | 1/2001 | Maurer | |
| 2004/0211677 | A1 | 10/2004 | Lewis | |
| 2007/0007910 | A1* | 1/2007 | Kim | H05B 41/2827 315/282 |
| 2007/0272546 | A1 | 11/2007 | Matthews | |
| 2012/0067719 | A1* | 3/2012 | Lagos Lehuede | C25C 1/00 204/229.4 |

* cited by examiner

METHOD OF SUPERIMPOSING ALTERNATING CURRENT ON DIRECT CURRENT IN ELECTROLYTIC METHODS

CROSS REFERENCE TO RELATED APPLICATION

This Application is a 371 of PCT/IB2014/066136 filed on Nov. 18, 2014, which claims priority of Chilean Patent Application No. 3315-2013 filed Nov. 19, 2013, each of which are incorporated herein by reference.

Technical Problem

The copper industry uses electric current rectifiers to produce copper, where a circulating electrolyte has copper dissolved in it (FIG. 2). The electric current generated by the rectifier causes the dissolved copper in the electrolyte to deposit on the cathode surface; this process according to Faraday's law is proportional to the circulating electrical current, and results in metallic copper of high purity. However, the process of deposition has restrictions regarding the ability to deposit copper on the cathode, since it is a proven fact that the arbitrary increase in current density at the electrodes generates deterioration of the chemical and physical quality of the copper deposited.

Currently, industrial facilities work with current densities of about 300-400 [A/m2]. An increase in the current level leads to an increased production, bringing however severe quality problems. In the classic process of electrowinning (EW) and electrorefining (ER), the control variables for the metallurgical process are the copper concentration, flow rate and temperature of the electrolyte. Increasing the temperature improves local mobility of ions, and the flow rate and concentration increase the availability of ions to react.

Industrial EW facilities for copper production with current densities higher than 300 [A/m2], retaining good physical quality of the retained copper, operate at temperatures above 45 [° C.], surface flow rates higher than 2.2 [l/min/m2] and copper concentrations of about 45 [g/l]. This brings a high operational cost, which is reasonable if the international assessment of copper is high, however in low and middle stages valuation, high operational cost is critical for the operational continuity of the factory.

In the case of ER facilities for copper, the current density is even further restricted due to the phenomenon of anodes passivation, which typically restricts current densities to 320 [A/m2] or lower, and yet they must operate at temperatures above 60 [° C.] to preserve the quality of the deposit. Flow rate is not a variable available in ER facilities, because an increase in flow rate will cause agitation of anodic slimes, which would contaminate the lower proportion of the produced cathodes.

The detailed study of the electrodeposition phenomenon it is not our objective, neither is the phenomena occurring at the interface electrode-electrolyte called "electrochemical double layer". However, it is necessary to mention that modeling electrochemical double layer defines, as its name implies, two perfectly differentiated layers of electrolyte having different behaviors: the inner layer or Helmholtz layer and the outer layer or diffuse layer (FIG. 3).

Inside the Helmholtz layer occurs the complex phenomenon of the transformation of the copper in solution into metallic copper. Due to the large accumulation of ions at such a small distance "waiting" to be deposited, a model can simply consider the Helmholtz layer as a capacitor composed of a metallic plate (the electrode) and a non-metallic plate consisting of high concentration of ions in the electrolyte. This non-metallic plate is connected in parallel with an impedance of resistive characteristic, representing the energy necessary to transform ion metal atoms in solution into the metal lattice of the cathode (copper reduction) (FIG. 4).

As for the diffuse layer, it comprises a concentration of ions ranging from near the Helmholtz layer to the typical concentration within the solution. Taken the Helmholtz layer aside, from the diffuse layer to the middle of the solution, ion transport phenomena occur, like migration due to the applied electric field and diffusion due to concentration variations. To improve these transportation phenomena exists a number of technologies, such as "air sparging" consisting of air injection to the electrolyte, which generates hydrodynamic improvements near the electrodes, and EMEW technology, which implements in practice an extra high flow rate operation. These technologies are however not applicable to mass production of copper, due to its high implementation cost, which restricts them to the treatment of marginal solutions. The viscosity of the electrolyte, which prevents mechanical agitation exerted from the electrolyte to the electrodes to approach the reaction zone at the electrochemical double layer, restricts the effect of the technologies mentioned above.

There is, however, the possibility of "electrically shaking" the electrolyte by varying the current that enters the electrolytic cells, by superimposing or overlaying an alternating current on the direct current classical electrodeposition process, using the capacitor of the Helmholtz layer as transportation means for the alternating electrical current. The metal plate of this capacitor (the electrode) withstands great variations of surface charge, as it is a metallic conductor. On the contrary, variations of electric charge in the non-metallic plate of this capacitor necessarily generate variations in the distribution of ions in the solution, because the ions occupy physical space within the solution. This means that the overlapping alternating current generates motion of ions near the electrolyte-electrode interface, and more precisely in the diffuse layer (FIG. 5). This implements a sort of "hydraulic pump" mobilizing ions near the electrode, in a region where mechanical agitation methods would not reach due to the viscosity of the solution.

A noteworthy aspect is that if the agitation has a sufficiently high frequency, the Helmholtz capacitor will bear large load variations without large voltage variations because its capacitance is extremely high. Thus, the phenomenon of conversion of ions in solution to integrated ions to the metal lattice occurs in the same manner as in the classical process, but with a great improvement in the quality of the transport phenomena near the electrode to the solution.

The appropriate frequency for agitation the interface by superimposing AC current to the classic process is determinable by test methods of impedance spectroscopy, resulting frequencies in the range of 5 to 10 [KHz]. Lower frequencies risk interfering with the operation of the direct current source (the rectifier transformer), and at higher frequencies the efficiency of AC generation systems decreases drastically.

In short, the technical problem regards to implementing the process of superimposing AC on DC for EW and ER in industrial electrolytic cells processes.

STATE OF THE ART

Currently, all proposed strategies to implement superimposing AC on DC have been limited to connect the AC source in parallel on the same point of connection used by the DC source, or between points in subgroup of cells, thus leaving the AC source exposed to direct voltages. Apart from this, the various proposals consist in source variations, bus connection variations, variations of the cell structure and/or mixtures of the variations mentioned above, as shown in FIG. 6.

In the case of the invention of Groole, (U.S. Pat. No. 2,026,466) of 1935, it comprises a charge controller, so the consumption of power from the primary power supply is approximately constant. The process or device alters the characteristic of the current supplied to the load, but does not regulate power.

This invention falls into the category shown in (c) of FIG. 6, even though at that time did not even exist rectifier transformers.

In the case of Lewis invention, (US 2004/0211677 A1) of 2004, it shows a new source, as in (b) of FIG. 6. Through this source circulates all the process flow, carrying DC as well as AC.

There is the case of Mathews invention (US 2007/0272546 A1). The application of this invention involves changing and discarding direct current sources operating at that time; changing and discarding the entire bus bar connection between the DC source and electrolytic cells; changing and discarding the entire structure of regular electrolytic cells. Then, new and not standardized equipment for industrial production replaces the previous equipment.

The present invention (INAPI 0817/2007), proposes to include a device that subtracts, accumulates and returns energy to the group of electrolytic cells consecutively, as in (d) of FIG. 6. This configuration sets the alternating current available for superimposing the direct current, without the need to alter the original installation. This application was approved in Australia, South Africa and the United States. In the United States it was divided into two patents, one of which claimed the process of generating alternating current by consecutively subtracting, accumulating and returning energy, and the other claims the device that performs the process; both patents are granted. In Chile it is still pending, but with positive expert examination report.

The case of the invention of Lagos (INAPI 0969/2009), it discloses two possibilities to implement two variants of similar devices with similar philosophy to those proposed by Bustos in 0817/2007, but not including storage capacitors. This invention claims that groups or subgroups of electrolytic cells can replace the function of these capacitors. In our opinion, this strategy is not applicable in the industry because of the size of electrolytic industrial plants; the connecting conductors would have inductances that are incompatible with the operation of devices such as IGBTs transistors, as shown in (e) and (f) of FIG. 6, which are representative of this application.

From the above analysis, it follows that the invention proposed in this document is represented schematically in (g) of FIG. 6, wherein the alternating current source connected to an inductor is included as part of the invention. This configuration is different from inventions and patent applications listed above as the connecting point represents a point of zero voltage on the DC source. The following specification describes the invention.

Proposed Solution

The proposed solution consists in changing the connecting point of the AC source for a point between any two consecutive cells connected electrically in series. Particularly, the optimal point of connection would be between intermediate cells in any typical circuit of cells for ER or EW. The addition of the alternate current source must come with the incorporation of two passive components: an inductor and a capacitor (FIG. 1).

The Inductor

The inductor connects in series with the cells. It acts as an AC filter and as a DC driving means (closing the circuit for circulating the direct current). It is possible to visualize that this inductor operates as a "magnetizing inductance"; it operates in the same way that the magnetizing inductance does in electrical transformers, supporting alternating voltage with minimal movement of alternating current, but in this case also acting as a short circuit for direct current. The inductance value of the incorporated inductor is determined so that the current in the inductor is negligible at the operating frequency of the AC source.

The Capacitor

The capacitor connects in parallel to the group of cells and in parallel to the DC source. It functions as conducting means for alternating current, closing the electrical circuit, and filters out any AC component that may possibly pass to the direct current source. The value of the incorporated capacitor capacity is determined so that the voltage variation on the capacitor, consequence of the circulating alternating current, is negligible at the operating frequency of the AC source. It is to be noted the fact that the capacitor will be exposed to the voltage imposed by the direct current source on the group of electrolytic cells. In this sense, fuses must be connected to the capacitor in order to clear any electrical faults.

The AC Source

The AC source can be implemented with any of the available technologies. The operating frequency of this source should be in the range defined between 5 and 10 [kHz] (as already mentioned above, in the presentation of the technical problem). The intensity of the current generated by this source depends on the value of the intensity of the direct current imposed by the direct current source.

INDUSTRIAL APPLICATION

Theoretical Basis

From the theoretical point of view, this invention is a paradigmatic principle of superposition of currents, where both sources operate independently. It shows the principle of duality between inductors that store energy in the form of magnetic field and capacitors that store energy in the form of electric field. In fact, the inductor is a short circuit for DC and an open circuit for high frequency AC, and on the other hand, the capacitor is a short circuit for AC and an open circuit for DC. It is evident also that the system including the classic elements plus the elements proposed in this invention has a characteristic frequency response.

Availability of Industrial Components

Currently there are physical components to implement such sources of high current and high frequency in a safe manner. However, the fact that the connection is made in a point of "zero tension", as it is the point between two cells, facilitates notably the design of the source protection, since it will be not exposed to the stress imposed by the direct current source of the group of electrolytic cells. On the contrary, this source will impose an alternating voltage to the inductor, which is in practice a short circuit imposed for the direct current source; this occurs thanks to the proposed innovation.

Induction Heating Sources Technology

Given the intensity and frequency of the current supplied by the AC source, it is convenient to use similar designs of those used in the sources of magnetic induction heating used for forging, extrusion, surface treatments and/or for melting metals. In general, these sources are designed using principles of resonance to amplify electric current. Normally these sources operate at frequencies in the range of 250 [Hz] to 10 [kHz] and with current levels between 1 and 10 [KA]. All the developed technology to design and manufacture sources of high current and high frequency for magnetic induction heating is applicable to design and manufacture sources to superimpose AC over the current imposed by DC sources for copper EW and ER and other products; this occurs thanks to the proposed innovation.

Use of Transformers and Autotransformers

A particular case of implementation of the process of superimposing alternating current occurs in the case of electrolytic refining (ER), in which a direct current source feeds a large number of cells connected in series divided into groups to perform the "harvest and planting" process partially. In this case, each particular group of cells operates at a reduced voltage because each electrorefining cell operates with voltages of about 250 [my]. Thus, for example, a group of 40 cells has a voltage of just 10 [V]. Therefore, it is appropriate to implement a single source of alternating current feeding in parallel to several groups of cells, which are connected in series with the DC source, by using transformers with galvanic isolation (FIG. 7). The secondary winding of the transformer acts equivalently to a winding driving the DC and injecting the AC.

In some cases, especially in small-scale plants, it is feasible to connect the AC source through an autotransformer so that the design of the AC source would be cheaper, and the current becomes amplified by a transformer or autotransformer for the secondary voltage, which is lower than the primary voltage (FIG. 8).

Implementation of Minimum Impact

From the standpoint of industrial implementation, the technology proposed in this invention can be implemented with minimal impact on the operation of the plant originally operated with a classical process of EW or ER, since the installation of components can be carried out virtually without interrupting normal operation.

From the point of view of system components, it is not necessary to modify or replace any component of the original system: the direct current source (rectifier transformer) remains unchanged and its operation does not suffer interference once the AC source begins to operate. The structure of the electrolytic cells do not suffer any modification, neither during the installation nor during the operation of the new AC source.

Rectifier Transformer Operation

As already mentioned, the installation and operation of the AC source does not cause any impact on the rectifier transformer. This happens because each electrolytic cell circuit in which the AC superimposing is implemented will necessarily have a capacitor installed, which closes the AC circuit and in turn removes any ripple component in the DC voltage imposed by the rectifier transformer. In practice, the incorporation of the capacitor means implementing an LC filter, as seen from the rectifier transformer to the group of electrolytic cells, in which "L" is the inductance of the bus bar connecting the rectifier transformer.

In this respect this technology is designed to protect the rectifier transformer; it is very clear that this is the main equipment in the ER and EW copper (and other products) plants.

Figure 1:
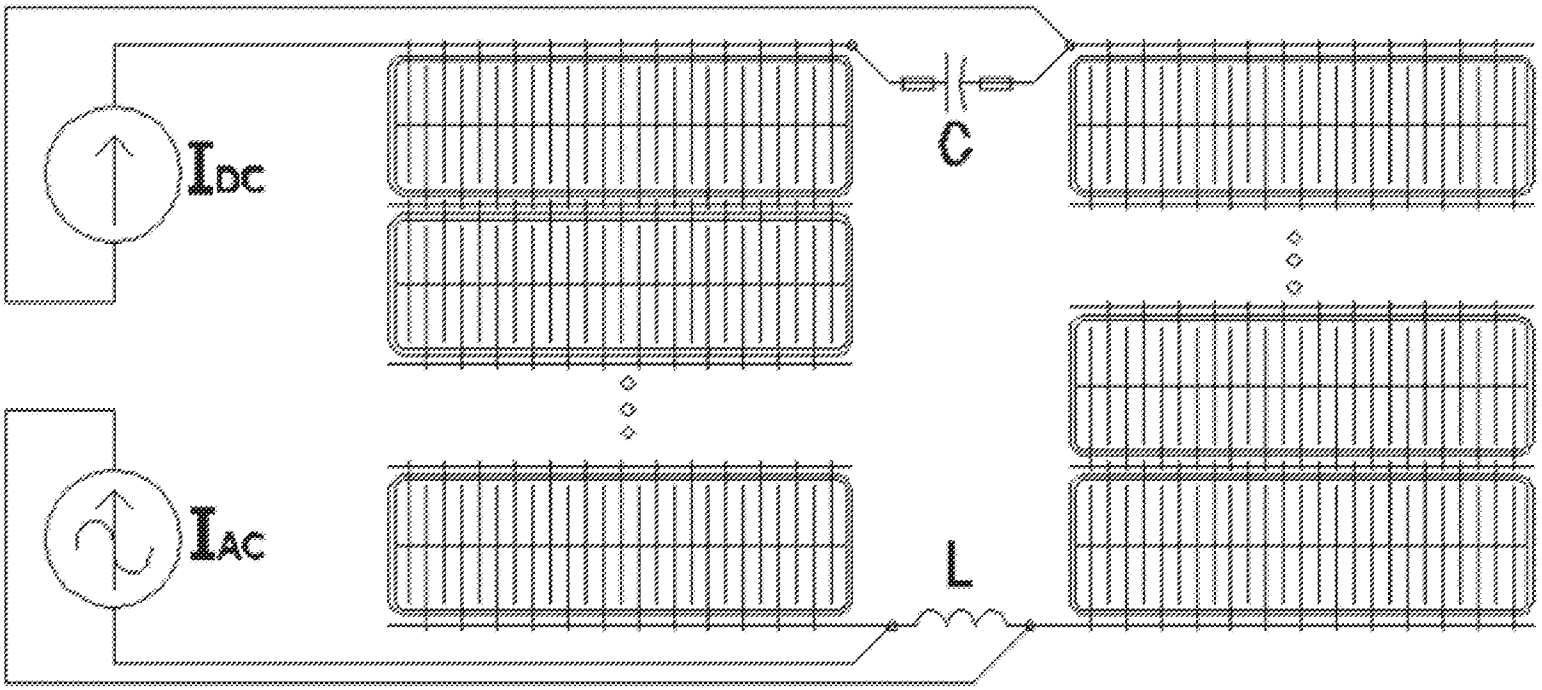
FIG. 1: Diagram of the proposed invention: to the original installation, the following components are added: an inductor between any two consecutive cells, a capacitor in parallel with the DC source, and an AC source connected to the terminals of the newly installed winding between two consecutive cells.
Figure 2:
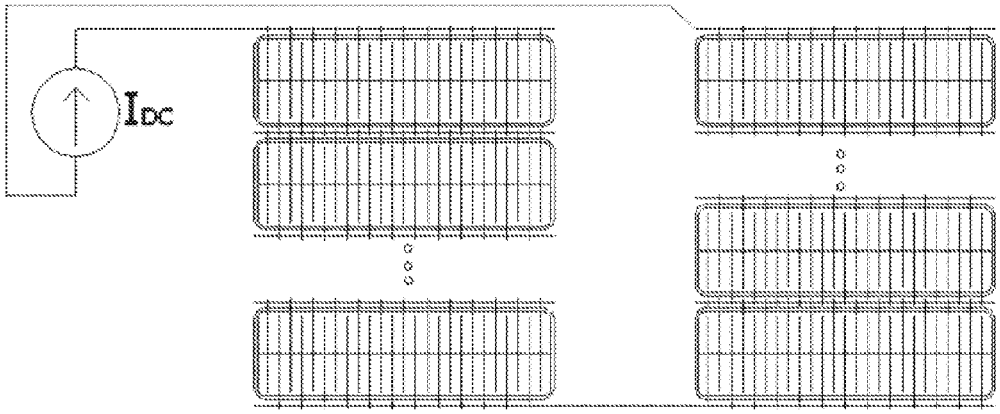
FIG. 2: Situation wherein the process of electrowinning or electrorefining of copper and other products is in operation: the rectifier current is continuous (DC) and enters the electrolytic vessel. The DC source is a rectifier transformer.
Figure 3:
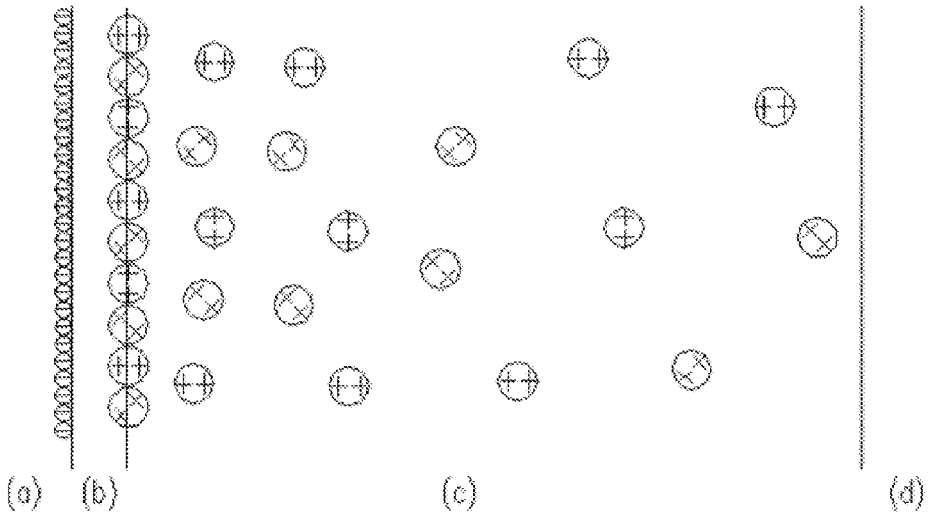
FIG. 3: Diagram of the electrochemical double layer composed by the inner layer or Helmholtz layer and by the outer or diffuse layer. Individualized sectors are: (a) inside the metal electrode; (b) the inner or Helmholtz layer; (c) the diffuse layer and (d) within the solution.
Figure 4:
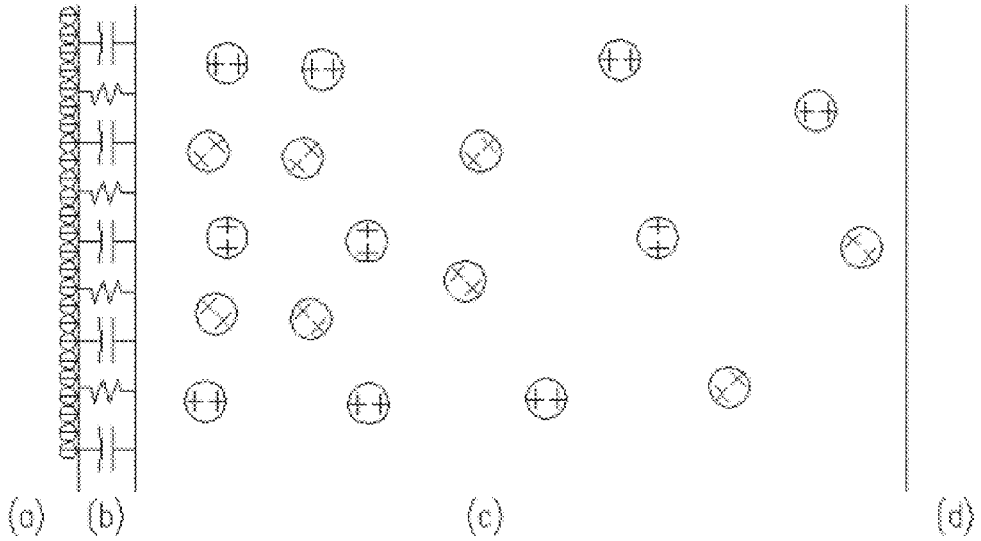
FIG. 4: Electric model of Helmholtz layer as a capacitor in parallel with a resistive element modeling energy consumption required to transform ions in solution into metallic atoms in a crystal lattice. Individualized sectors are: (a) inside the metal electrode; (b) the inner or Helmholtz layer modeled as a capacitor bank and a resistive element representing the energy to transform dissolved ions in solution into metal atoms in a crystal lattice; (c) the diffuse layer and (d) within the solution.
Figure 5:
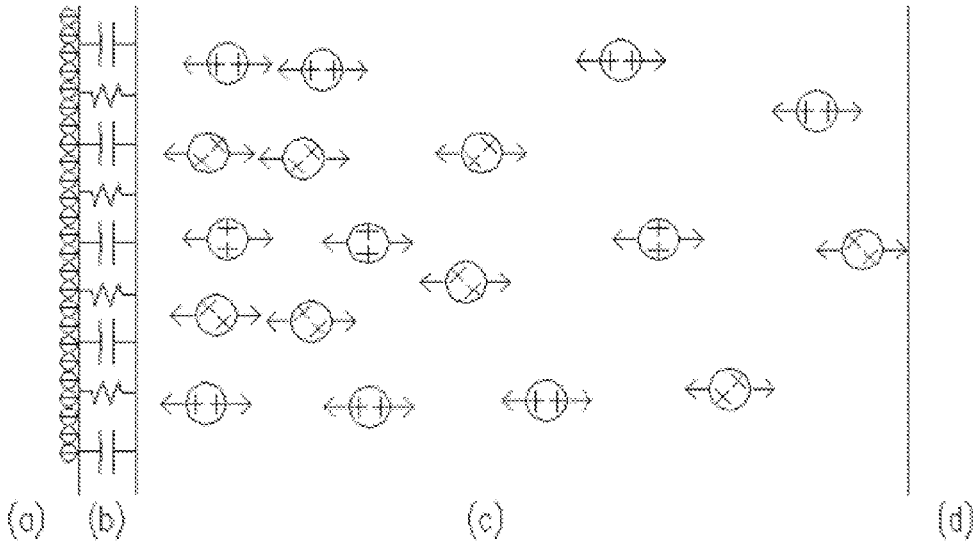
FIG. 5: The hydraulic pump generated by superimposing AC over the DC of the classical model: A variation in the load of the electrode metal plate necessarily causes the movement of ions in solution in the perpendicular direction towards the surface of electrode. Individualized sectors are: (a) inside the metal electrode, which surface accumulates charges in a minimum width space, as it is a metallic conductor; (b) the inner or Helmholtz layer modeled as a capacitor bank and a resistive element representing the energy to transform dissolved ions in solution into the metal atoms in crystal lattice; (c) the diffuse layer in which occurs the agitation of ions in solution in the direction of the electric field imposed by the current superposed; and (d) within the solution.
Figure 6:
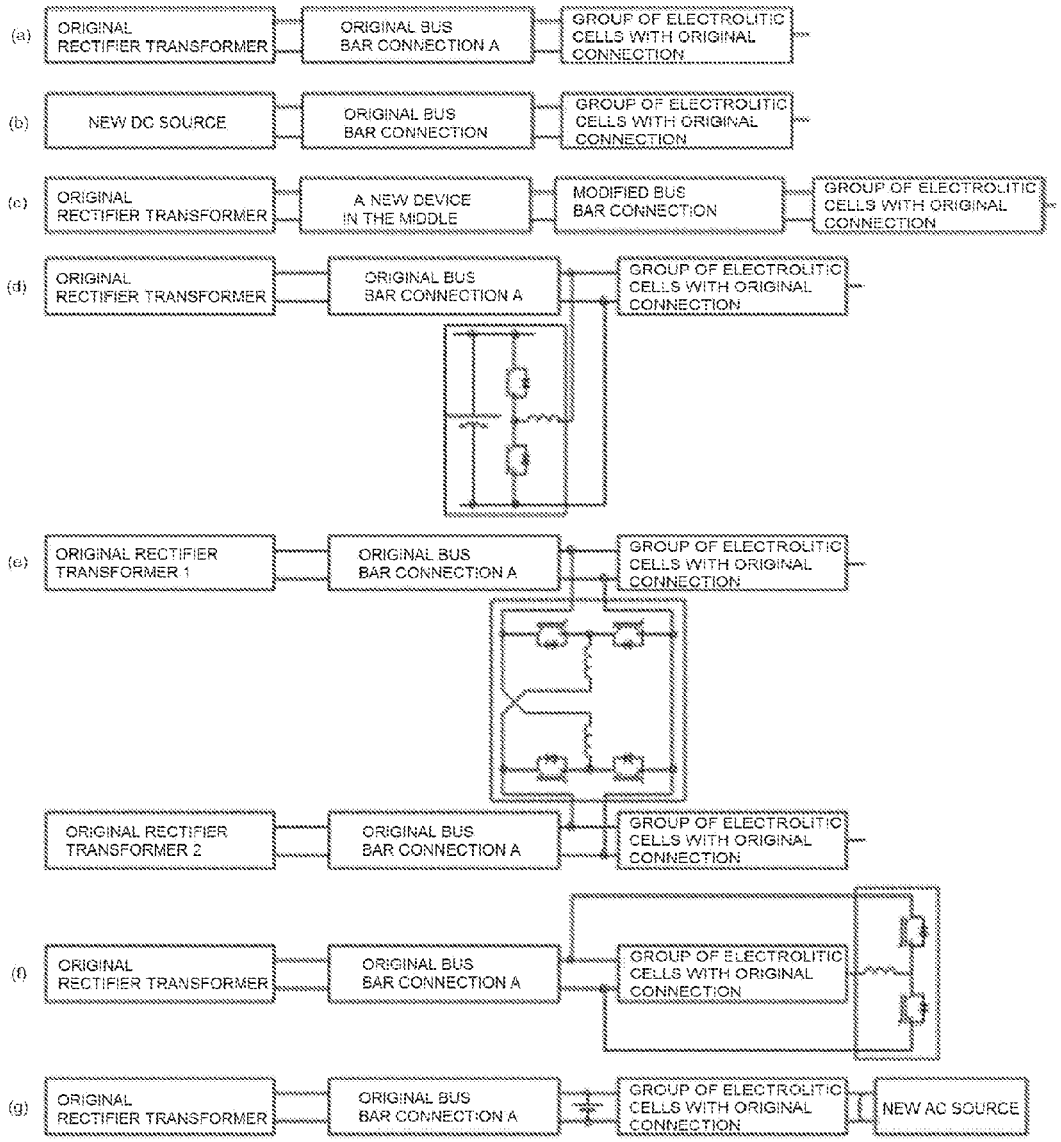
FIG. 6: Diagram of alternative implementation for the superimposing of AC over DC: (a) represents the original typical situation in EW plants; (b) represents an implementation in which the original direct current source is changed by a completely new one with the ability to deliver overlaid current; (c) represents an implementation in which a new source in included modifying the original current by superimposing a high frequency current, so the original bus bars must be replaced by other, receptive to the high frequency of the alternating current; (d) represents the implementation of a current generation process with the steps of subtraction, accumulation and subsequent return; (e) and (f) represent similar implementations to that shown in d, but replacing the use of energy storage capacitors by a subgroup of electrolytic cells; (g) represents the proposed invention.
Figure 7:
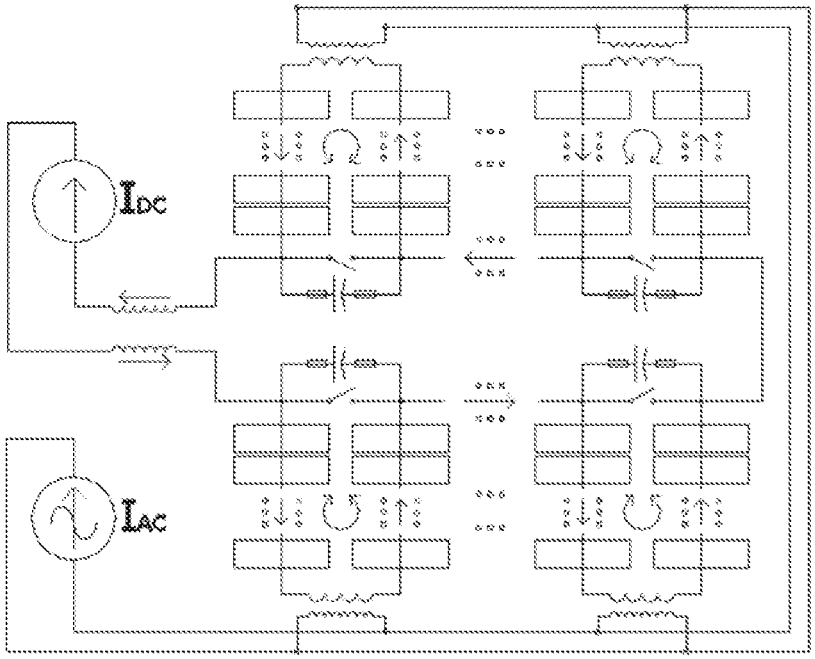
FIG. 7: Diagram of the proposed invention particularly suitable for electrolytic refining (ER): In the original installation, transformers are connected in the middle point and capacitors are connected in parallel at the connection points of the direct current source. An alternating current source is used for various groups of electrolytic cells.
Figure 8:
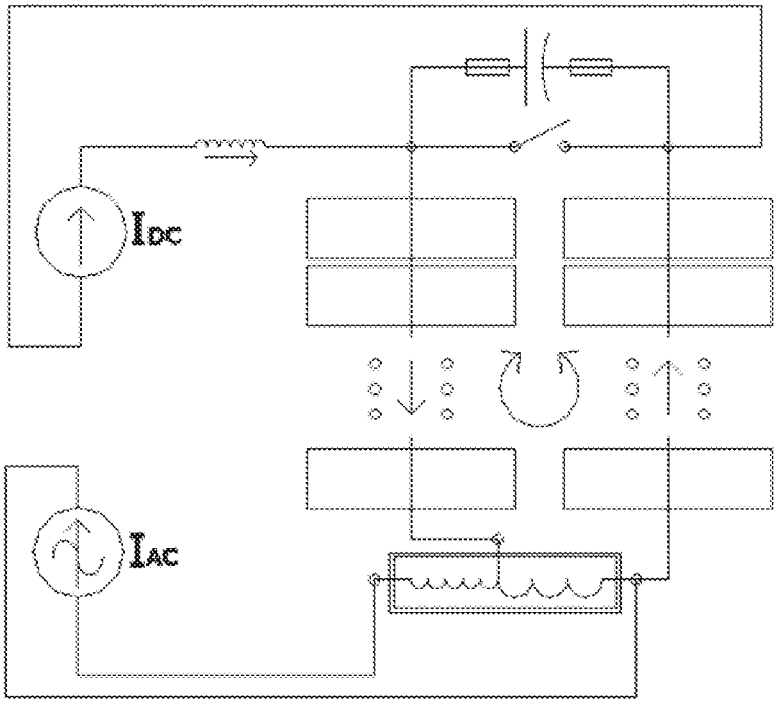
FIG. 8: Diagram of the proposed invention particularly suitable for small plants (EW): In the original installation, an autotransformer is connected at the middle point and a capacitor is connected in parallel to the connection points of the direct current source. A low current/high voltage AC source is connected in the primary circuit of the autotransformer.

The invention claimed is:

1. A system for superimposing AC over DC, which feeds a group of electrolytic cells for electrorefining copper and other products, the group of cells comprising subgroups, the system comprising:

(a) a capacitor connected in parallel to a DC source feeding the group of electrolytic cells, (b) an inductor connected in series between two consecutive cells of the group of electrolytic cells, and (c) an AC source connected in parallel to the inductor;

wherein, in addition to the DC, a minor fraction of the AC flows through the inductor generating AC voltage at its terminals, allowing a major fraction of the AC to flow through the group of electrolytic cells, using the capacitor as circuit path for the AC without interfering with the DC source.

2. A system for superimposing AC over DC, which feeds a group of electrolytic cells for electrowinning or electrorefining copper and other products, comprising:

(a) a capacitor connected in parallel to a DC source feeding the group of electrolytic cells, (b) a secondary winding of an electric transformer connected in series between two consecutive cells of the group of electrolytic cells, and (c) an AC source connected in parallel to a primary winding of the electric transformer;

wherein, in addition to the DC, AC flows through the secondary winding of the transformer and through the group of electrolytic cells, using the capacitor as a circuit path to AC without interfering with the DC source.

3. A system for superimposing AC over DC, which feeds a group of electrolytic cells for electrowinning or electrorefining copper and other products, comprising:

(a) a capacitor connected in parallel to a DC source feeding the group of electrolytic cells, (b) a fraction of an electric autotransformer winding connected in series between two consecutive cells of the group of electrolytic cells, and (c) an AC source connected in parallel to the electric autotransformer winding;

wherein, in addition to the DC, AC flows through the fraction of auto transformer winding and through the group of electrolytic cells, using the capacitor as a circuit path to AC without interfering with the DC source.

4. A system for superimposing AC over DC, which feeds a group of electrolytic cells for electrorefining copper and other products, comprising:

(a) a capacitor connected in parallel to an original DC source of each subgroup of cells, (b) a secondary winding of an electric transformer connected in series between two consecutive cells of each subgroup of electrolytic cells, and (c) an AC source connected in parallel to a primary winding of the transformers;

wherein, in addition to the DC, AC flows through the secondary winding of each transformer and each subgroup of electrolytic cells, using the capacitor of each subgroup of cells as a circuit path for the AC without interfering with the DC source.

* * * * *